US010066420B2

(12) United States Patent
Cheng

(10) Patent No.: US 10,066,420 B2
(45) Date of Patent: Sep. 4, 2018

(54) EASILY-ASSEMBLED MODULAR DOOR LOCK

(71) Applicant: Qianyan Cheng, Sacramento, CA (US)

(72) Inventor: Qianyan Cheng, Sacramento, CA (US)

( * ) Notice: Subject to any disclaimer, the term of this patent is extended or adjusted under 35 U.S.C. 154(b) by 552 days.

(21) Appl. No.: 14/685,852

(22) Filed: Apr. 14, 2015

(65) Prior Publication Data

US 2015/0292241 A1 Oct. 15, 2015

(30) Foreign Application Priority Data

Apr. 14, 2014 (CN) ..... 2014 2 0180305 U

(51) Int. Cl.
*E05B 55/00* (2006.01)
*E05C 1/16* (2006.01)
*E05B 13/00* (2006.01)

(52) U.S. Cl.
CPC ..... *E05B 55/005* (2013.01); *E05B 13/004* (2013.01); *E05C 1/163* (2013.01)

(58) Field of Classification Search
CPC ..... Y10T 70/7915; Y10T 70/8649; Y10T 70/498; Y10T 70/5867; Y10T 74/2014; E05B 13/001; E05B 77/44; Y10S 292/02; Y10S 70/56; Y10S 70/58; F16H 61/22; F16K 35/10
USPC ..... 292/138, 137, 163–165, 169
See application file for complete search history.

(56) References Cited

U.S. PATENT DOCUMENTS 4,871,202 A * 10/1989 Friedrichs ..... E05C 1/163 292/169
5,259,652 A * 11/1993 Adams ..... E05B 13/002 292/169.14
5,364,138 A * 11/1994 Dietrich ..... E05B 63/06 292/1.5
6,877,783 B2 * 4/2005 Atkinson ..... E05B 53/003 292/171
2005/0057051 A1 * 3/2005 Bartos ..... E05C 1/163 292/337

* cited by examiner

*Primary Examiner* — Mark A Williams
(74) *Attorney, Agent, or Firm* — Heisler & Associates

(57) ABSTRACT

The modular door lock includes a tubular shell with a lock tongue at an open end and a turning wheel in the shell. The outer edge of the turning wheel extends out to a flange. A support frame lies between the turning wheel and the lock tongue and a drive is set in the frame. The lock tongue is permanently connected with a connection strap, which is drive-jointed with the turning wheel flange end via the drive. The door lock has a first state causing the lock tongue to draw back into the shell opening end through the drive and the connection strap, as well as a second state that causes the lock tongue to automatically reach outwards, the turning wheel to automatically rotate to the initial position, and the connection strap and drive mechanism to automatically return to their initial positions under the movement of the tongue.

18 Claims, 8 Drawing Sheets

EASILY-ASSEMBLED MODULAR DOOR LOCK

CROSS-REFERENCE TO RELATED APPLICATIONS

This application claims priority of Chinese Patent No. ZL201420180305.0 issued on Aug. 27, 2014 and filed on Apr. 14, 2014.

FIELD OF THE INVENTION

This invention relates to a door lock, to be specific, an easily-assembled modular door lock. It belongs to the technical field of locks.

BACKGROUND OF THE INVENTION

As far as the applicant is concerned, door locks which need to be used together with keys are usually used in access doors or bathroom doors in the existing technologies. However, these door locks usually have the following shortcomings: (1) many parts, non-modular structure and cumbersome assembly, thus being inconducive to the enhancement of production efficiency; (2) inadequate fastness and the shell is prone to deformation or even fracture under big impact, thus leading to functional failure of locks.

Chinese utility model patent (Patent No. 01264119.7) has disclosed the specific structure of a latch used in a door lock. Although with less parts, its locating structure for parts are mainly located on the shell, so, on the one hand, it makes assembly quite difficult. On the other hand, in case of deformation of the shell under outside force, the internal parts are prone to shifting, causing latch failure.

SUMMARY OF THE INVENTION

The technical problem to be solved by this invention is: overcoming the problems in the existing technologies and providing an easily-assembled modular lock, which has a modular structure, can reduce assembly difficulty and enhance production efficiency.

To solve this technical problem, the technical scheme of this invention is as follows. An easily-assembled modular door lock is provided, featured by a tubular shell. The shell is open at one end and closed at the other. A lock tongue is set at the open end of the shell and the relative two sides are respectively equipped with a first through hole which facilitates the passage of the handle square bar. A turning wheel is set in the shell and it has a second through hole to match the handle square bar. The outer edge of the turning wheel extends out of the end face and faces the flange of the shell open end. A support frame lies between the turning wheel and the lock tongue in the shell and a drive mechanism is set in the frame. The end of the lock tongue near the closed end of the shell is permanently connected with a connection strap, which is drive-jointed with the turning wheel flange end via the drive mechanism.

The door lock has a first state of rotating the turning wheel with external force and making the turning wheel flange end drive the lock tongue to draw back into the shell open end through the drive mechanism and the connection strap. The door lock also has a second state that, after the external force is removed, the lock tongue will automatically reach outwards, the turning wheel will automatically rotate to the initial position, and the connection strap and drive mechanism will automatically return to their initial positions under the movement of the lock tongue.

This invention adapts to a support frame to support the drive mechanism, thus the drive mechanism and the support frame can be assembled outside the shell beforehand. Then, the support frame is mounted in the shell and the drive mechanism is respectively connected with the connection strap and the turning wheel flange end, so as to realize modular assembly. Such a modular structure effectively reduces assembly difficulty and enhances production efficiency.

A further improved technical scheme of this invention includes: preferably, the support frame comprises two support plates arranged up and down and parallel to each other, the parts of the two support plates near the closed end of the shell are fixed together via a supporting column. The two support plates form a space for containing and supporting the drive mechanism. The same side of the two support plates has a support chip respectively and a track is formed between the two chips. In the above optimized structure, the support frame can fix the drive mechanism more effectively and can enhance the firmness of the entire lock.

Preferably, the door lock also comprises a guide pile. The drive mechanism comprises an elongated thrust plate which extends along the movement direction of the lock tongue and a cam-shaped pick. The thrust plate lies in the track and forms a sliding pair. The pick is contained between the two support plates and close to the open end of the shell.

The pick has a rotary point. Both ends of the pick lie on the two sides of the rotary point and respectively face the closed end of the shell. One end of the thrust plate contacts the turning wheel flange end and the other end contacts one end of the pick, while the other end of the pick contacts the protruding plate of the connection strap. One end of the pick is closer to the rotary point of the pick than its other end.

The pick is perpendicular to the guide pile. The rotary point of the pick is rotary-jointed with the guide pile. Both ends of the guide pile pass through the support plates and are permanently connected with the shell. The pick has an arc-shaped edge with its arc facing the opening end of the shell. The protruding plate of the connection strap lies on the side of the pick near the closed end of the shell.

In the above optimized structure, the drive mechanism can realize the drive effect in a simpler, more effective and reliable manner without deactivation. The guide pile not only positions the movement of the drive mechanism, but also prevents the key parts of the shell from deformation in the case of great impact, thereby enhancing the soundness of the entire lock.

Preferably, the shell is also equipped with a lock tongue baffle plate vertical to the movement direction of the lock tongue. The lock tongue baffle plate lies between the lock tongue and the support frame. The lock tongue baffle plate has a third through hole in the middle for the passage of the connection strap. The protruding plate of the connection strap lies on the side of the lock tongue baffle plate away from the lock tongue. A first elastomer is set between the lock tongue baffle plate and the lock tongue. The side of the turning wheel away from its flange extends out a support handle towards the closed end of the shell. A second elastomer is set between the support handle and the side of the shell close to the turning wheel flange. A notch is provided on the side of the shell close to the turning wheel flange.

When the door lock is in a first state, the first and second elastomers are respectively at the first compression state, and the turning wheel flange end contacts the edge of the notch close to the open end of the shell. When in a second state, the first and second elastomers are respectively in a stretched state or at the second compression state, and the turning wheel flange end lies in the notch. The compression amount of the first and second elastomers at the first compression state is bigger than their compression amount at the second compression state.

More preferably, the connection strap comprises a baseplate extending along the movement direction of the lock tongue. One end of the baseplate lies on the side of the lock tongue baffle plate away from the lock tongue and is contained in the support frame, while the other end lies on the other side of the lock tongue baffle plate near the lock tongue and is fixed with the lock tongue. The baseplate extends out an accessory plate close to its one end. The protruding plate lies at the end of the accessory plate and is permanently connected with the accessory plate. The protruding plate is vertical to the movement direction of the lock tongue.

More preferably, when the door lock transforms from the first state to the second state, the turning wheel has a rotary angle of 28°. In the above optimized structure, the lock tongue baffle plate and the notch of the shell can play their respective stopping role, making the operation of the entire lock more precise. At the same time, the lock tongue baffle plate can also strengthen the firmness of the shell. The connection strap can further ensure the effective connection between the lock tongue and the drive mechanism. The turning wheel has a rotary angle of 28°, making it much easier to open the lock, especially for the elderly and children.

Preferably, the door lock also comprises a column-shaped braking element which is parallel to the central axis of the first through hole. The braking element extends out a limit boss towards the turning wheel. The turning wheel is provided with a groove to match the limit boss. The braking element runs through the support frame, with both ends exposed out of the shell and respectively equipped with a ring part circumferentially. Both ends of the braking element are respectively fixed with first and second stop bolts. A gasket is set between the caps of the first and second stop bolts and the corresponding ring parts. When the door lock is at the second state, the braking element has the braking state that the limit boss enters the groove and obstructs the turning wheel from rotating. The first stop bolt is jointed with the corresponding ring part, and the second stop bolt breaks away from the corresponding ring part. The lock also has the non-braking state that the limit boss breaks away from the groove so that the turning wheel can rotate. The first stop bolt breaks away from corresponding ring part and the second stop bolt is jointed with the corresponding ring part. When the door lock is at the first state, the braking element only has the non-braking state.

More preferably, the braking element is equipped with a chute extending along the movement direction of the lock tongue. The section of the chute along the movement direction of the lock tongue is formed by the smooth connection of a rectangular chute segment away from the lock tongue and an isosceles trapezoidal chute segment close to the lock tongue. The rectangular chute segment and the isosceles trapezoidal chute segment are symmetric on the same axis of symmetry. The side of the isosceles trapezoidal chute segment near the lock tongue is wider on the side away from the lock tongue. When the door lock is at the first state, the end of the connection strap away from the lock tongue lies in the rectangular chute segment. When it is at the second state, the end of the connection strap away from the lock tongue lies in the isosceles trapezoidal chute segment.

More preferably, one side of the braking element is provided with a set of ball type spacing holes arranged along a line. The support frame has a fourth through hole, which contains the third elastomer and ball, one end of the third elastomer contacts the side of the shell, while the other end presses the ball into one of the ball type spacing holes.

In the above optimized structure, the braking element makes the door lock more suitable to be mounted on the bathroom door. Moreover, the braking element is convenient for use, just by pressing it to brake the lock. The chute of the braking element can make the braking element automatically reset to a non-braking state when the lock tongue draws back into the shell under outside force, that is, to realize the automatic unlocking function of the lock tongue. In the meantime, the chute enables the installation of the door lock without distinguishing the inside and outside door directions. What needs to be done is just adjusting the initial installation position of the braking element based on the actual situations, thus effectively reducing the inventory. In addition, the ball type spacing hole of the braking element can effectively limit and maintain the position of the braking element.

Preferably, the door lock also comprises a lining board and panel permanently connected with the external door leaf via fasteners. The lining board is located between the panel and the open end of the shell. The lining board has a circular hole for the passage of lock tongue and the panel has a spacing hole for the passage and locking of the lock tongue. The edge of the spacing hole is composed of a curved segment and a straight segment. The lock tongue has a limit dais protruding to the spacing hole. The four corners of the lining board are round.

In the above optimized structure, the lining board with circular holes can be retained upon the panel replacement, thus effectively reducing the inventory. This invention, marked by simple assembly and high fastness, can effectively overcome the problems in the existing technologies.

DESCRIPTION OF THE PREFERRED EMBODIMENT

Figure 1:
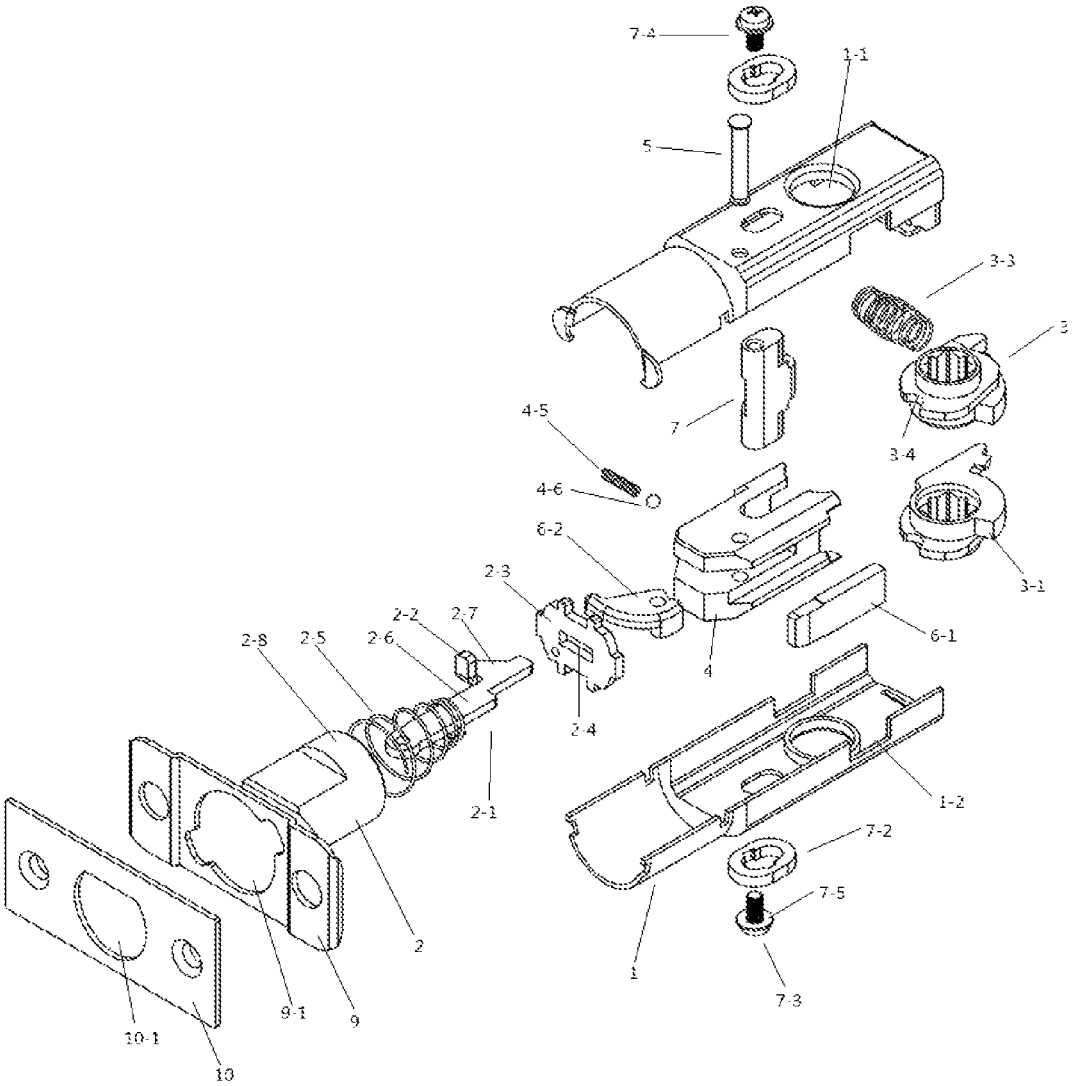
FIG. 1 is an exploded view of embodiment 1 of this invention.
Figure 2:
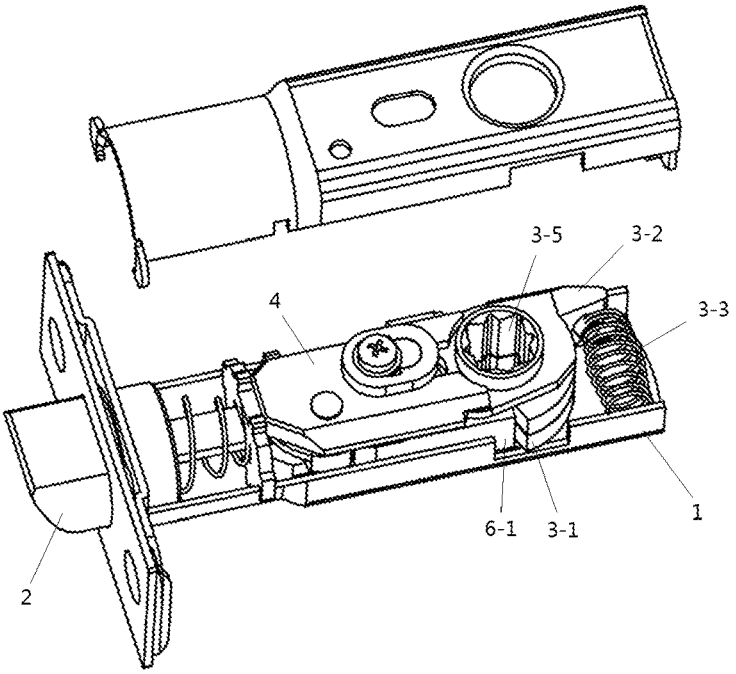
FIG. 2 and FIG. 3 are the partially assembled exploded views showing the extending lock tongue in the embodiment of FIG. 1.
Figure 3:
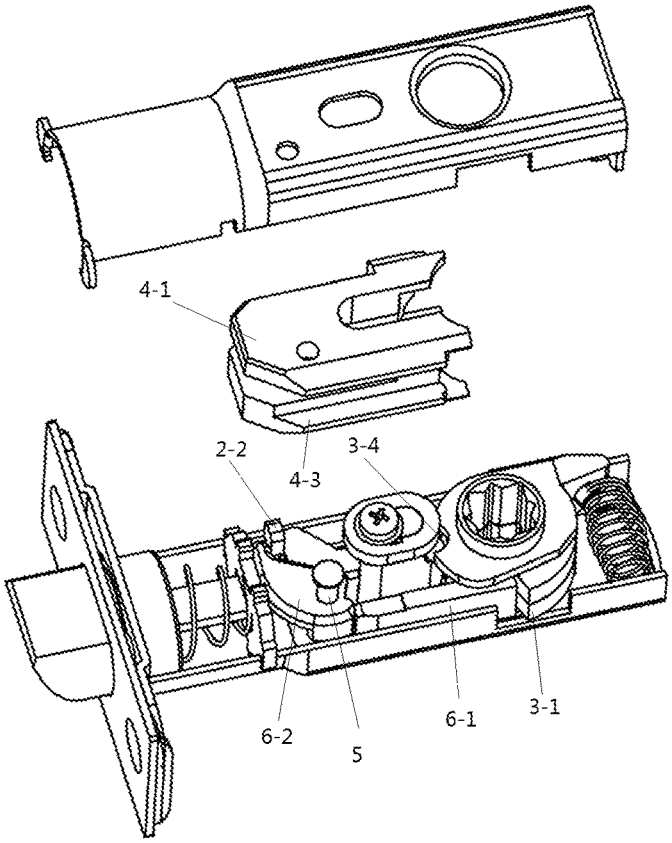
Figure 4:
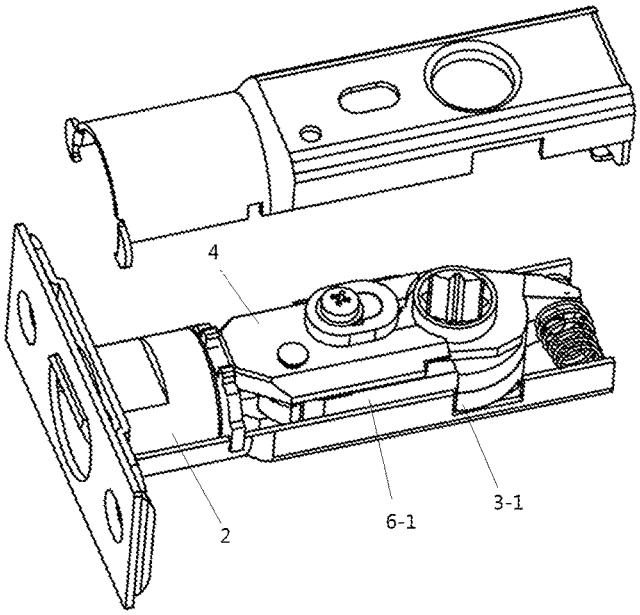
FIG. 4 and FIG. 5 are partially assembled exploded views showing the retracted lock tongue in the embodiment of FIG. 1.
Figure 5:
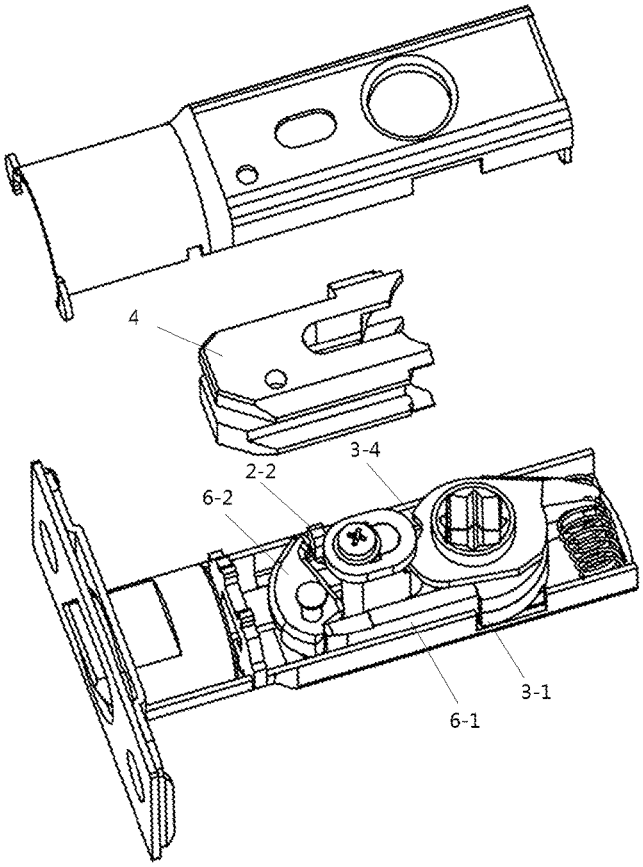
Figure 6:
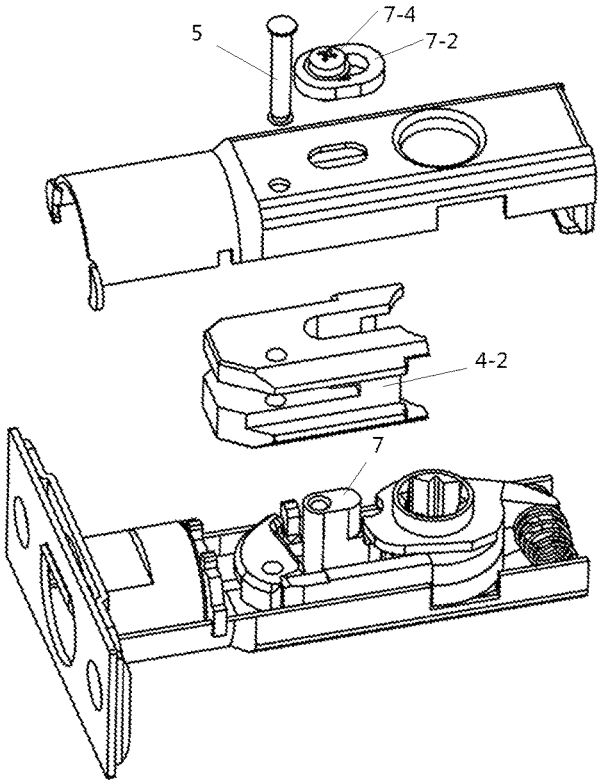
FIG. 6 is a partial breakdown view of that which is shown in FIG. 5.

Further details of this invention are given by referring to the drawings in the following pages, but this invention is not limited to the given embodiments.

Embodiment 1

The easily-assembled door lock in this embodiment is applicable to bathroom doors. Its basic structure is as shown in FIG. 1 to FIG. 21, comprising a tubular shell 1, which is open at one end and closed at the other. A lock tongue 2 is set at the open end of the shell 1 and two relative sides of shell 1 are respectively equipped with a first through hole 1-1 which facilitates the passage of the handle square bar. A turning wheel 3 is set in the shell 1 and the turning wheel 3 has a second through hole 3-5 to match the handle square bar. The outer edge of the turning wheel 3 extends out of the end face and faces the flange 3-1 of the shell 1 open end. A support frame 4 lies between the turning wheel 3 and the lock tongue 2 in the shell 1 and a drive mechanism is set in the frame 4. The end of the lock tongue 2 near the closing end of the shell 1 is permanently connected with a connection strap 2-1, which is drive-jointed with the turning wheel flange 3-1 end via the drive mechanism.

The door lock has a first state of rotating the turning wheel 3 by virtue of external force and making the turning wheel flange 3-1 end drive the lock tongue 2 to draw back into the shell 1 opening end through the drive mechanism and the connection strap 2-1. The door lock also has a second state that after the external force is removed, the lock tongue 2 will automatically reach outwards, the turning wheel 3 will automatically rotate to the initial position, and the connection strap 2-1 and drive mechanism will automatically return to their initial positions under the movement of the lock tongue 2. In this embodiment, the turning wheel 3 is formed by two half-wheel pairs so that the operations inside and outside the door will not interfere with each other.

As shown in FIG. 9 to FIG. 14, the support frame 4 comprises two support plates 4-1 arranged parallel and opposite each other. The parts of the two support plates 4-1 near the closed end of the shell 1 are fixed together via a supporting column 4-2. The two support plates 4-1 form a space for containing and supporting the drive mechanism. The same side of the two support plates 4-1 has a support chip 4-3 respectively and a track is formed between the two chips 4-3.

The door lock in this embodiment also comprises a guide pile 5. The drive mechanism comprises an elongated thrust plate 6-1 which extends along the movement direction of the lock tongue 2 and a cam-shaped pick 6-2. The thrust plate 6-1 lies in the track and forms a sliding pair. The pick 6-2 is contained between the two support plates 4-1 and close to the open end of the shell 1.

The pick 6-2 has a rotary point, both ends of the pick 6-2 lie on the two sides of the rotary point and respectively face the closed end of the shell 1. One end of the thrust plate 6-1 contacts the turning wheel flange 3-1 end and the other end contacts one end of the pick 6-2, while the other end of the pick 6-2 contacts the protruding plate 2-2 of the connection strap 2-1. One end of the pick 6-2 is closer to the rotary point of the pick 6-2 than its other end.

The pick 6-2 is perpendicular to the guide pile 5. The rotary point of the pick 6-2 is rotary-jointed with the guide pile 5. Both ends of the guide pile 5 pass through the support plates 4-1 and are permanently connected with the shell 1. The pick 6-2 has an arc-shaped edge with its arc facing the opening end of the shell 1. The protruding plate 2-2 of the connection strap lies on the side of the pick 6-2 near the closed end of the shell 1. In this embodiment, the shell 1 is formed by the permanent connection between two half-shells through the guide pile 5.

The shell 1 is also equipped with a lock tongue baffle plate 2-3 inside, vertical to the movement direction of the lock tongue 2. The lock tongue baffle plate 2-3 lies between the lock tongue 2 and the support frame 4. The lock tongue baffle plate 2-3 has a third through hole 2-4 in the middle for the passage of the connection strap 2-1. The protruding plate 2-2 of the connection strap lies on the side of the lock tongue baffle plate 2-3 away from the lock tongue 2. A first elastomer 2-5 is set between the lock tongue baffle plate 2-3 and the lock tongue 2. The side of the turning wheel 3 away from its flange 3-1 extends out a support handle 3-2 towards the closed end of the shell 1. A second elastomer 3-3 is set between the support handle 3-2 and the side of the shell 1 close to the turning wheel flange 3-1. A notch 1-2 is set on the side of the shell 1 close to the turning wheel flange 3-1.

When the door lock is in a first state, the first and second elastomers 2-5, 3-3 are respectively in the first compression state, and the turning wheel flange 3-1 end contacts the edge of the notch 1-2 close to the opened end of the shell 1. When it is in a second state, the first and second elastomers 2-5, 3-3 are respectively in a stretched state or in a second compression state, and the turning wheel flange 3-1 end lies in the notch 1-2. The compression amount of the first or second elastomers 2-5 or 3-3 in the first compression state is bigger than their compression amount in the second compression state.

To be specific, the first elastomer 2-5 is a spring surrounding the connection strap 2-1 and with its two ends respectively fixed or jointed with lock tongue 2 and lock tongue baffle plate 2-3. The second elastomer 3-3 is a spring with its two ends respectively fixed or jointed with the handle of turning wheel 3 and the side of shell 1.

The connection strap 2-1 comprises a baseplate 2-6 extending along the movement direction of the lock tongue 2. One end of the baseplate 2-6 lies on the side of the lock tongue baffle plate 2-3 away from the lock tongue 2 and is contained in the support frame 4, while the other end lies on the other side of the lock tongue baffle plate 2-3 near the lock tongue 2 and is fixed with the lock tongue 2. The baseplate 2-6 extends out an accessory plate 2-7 close to its one end. The protruding plate 2-2 lies at the end of the accessory plate 2-7 and is permanently connected with the accessory plate 2-7. The protruding plate 2-2 is vertical to the movement direction of the lock tongue 2. When the door lock transforms from the first state to the second state, the turning wheel 3 has a rotary angle of 28°.

As shown in FIG. 15 to FIG. 20, the door lock in this embodiment also comprises a column-shaped braking element 7 which is parallel to the central axis of the first through hole 1-1. The braking element 7 extends out a limit boss 7-1 towards the turning wheel 3. The turning wheel 3 has a groove 3-4 to match the limit boss 7-1. The braking element 7 runs through the support frame 4. The supporting column 4-2 of the support frame 4 has two sides respectively arranged in the braking element. The two ends of the braking element 7 are exposed out of the shell 1 and are respectively equipped with a ring part 7-2 circumferentially. Both ends of the braking element 7 are respectively fixed with first and second stop bolts 7-3, 7-4. A gasket 7-5 is set between the caps of the first and second stop bolts 7-3, 7-4 and the corresponding ring parts 7-2 (the gasket can be integrated with or separated from the stop bolts or integrated with or separated from the ring parts).

When the door lock is in the second state, the braking element 7 has the braking state where the limit boss 7-1 enters the groove 3-4 and obstructs the turning wheel 3 from rotating, the first stop bolt 7-3 is jointed with corresponding ring part 7-2, and the second stop bolt 7-4 breaks away from the corresponding ring part. The braking element 7 also has a non-braking state where: the limit boss 7-1 breaks away from the groove 3-4 so that the turning wheel 3 can rotate, the first stop bolt 7-3 breaks away from corresponding ring part 7-2 and the second stop bolt 7-4 is jointed with corresponding ring part 7-2. When the door lock is at the first state, the braking element 7 only has the non-braking state.

The braking element 7 is equipped with a chute 8 extending along the movement direction of the lock tongue 2. The section of the chute 8 along the movement direction of the lock tongue 2 is formed by the smooth connection of a rectangular chute segment 8-1 away from the lock tongue 2 and an isosceles trapezoidal chute segment 8-2 close to the lock tongue 2. The rectangular chute segment 8-1 and the isosceles trapezoidal chute segment 8-2 are symmetric on the same axis of symmetry. The side of the isosceles trapezoidal chute segment 8-2 near the lock tongue 2 is wider on the side away from the lock tongue 2. When the door lock is in the first state, the end of the connection strap 2-1 away from the lock tongue 2 lies in the rectangular chute segment 8-1. When it is at the second state, the end of the connection strap 2-1 away from the lock tongue 2 lies in the isosceles trapezoidal chute segment 8-2 of chute 8.

Figure 7:
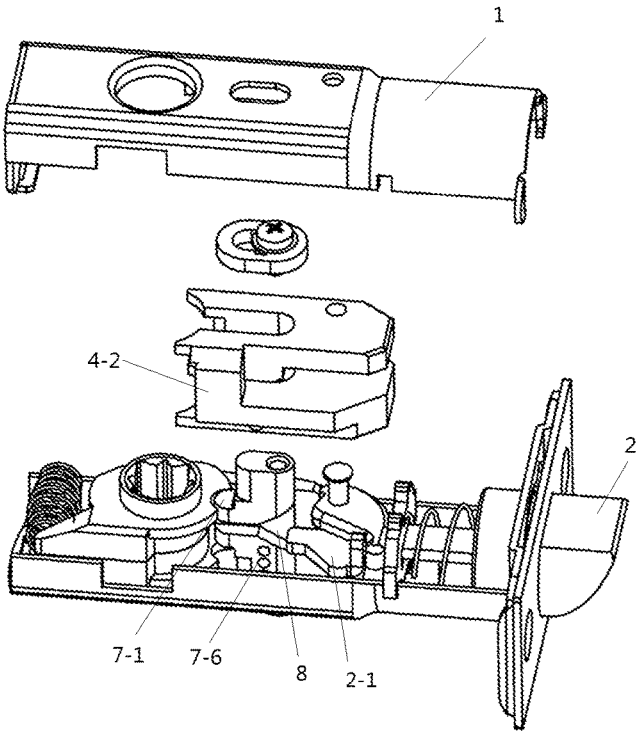
FIG. 7 and FIG. 8 are partially assembled exploded views of the automatic unlocking function of the lock tongue in the embodiment of FIG. 1, shown extending (FIG. 7) and retracted (FIG. 8).
Figure 8:
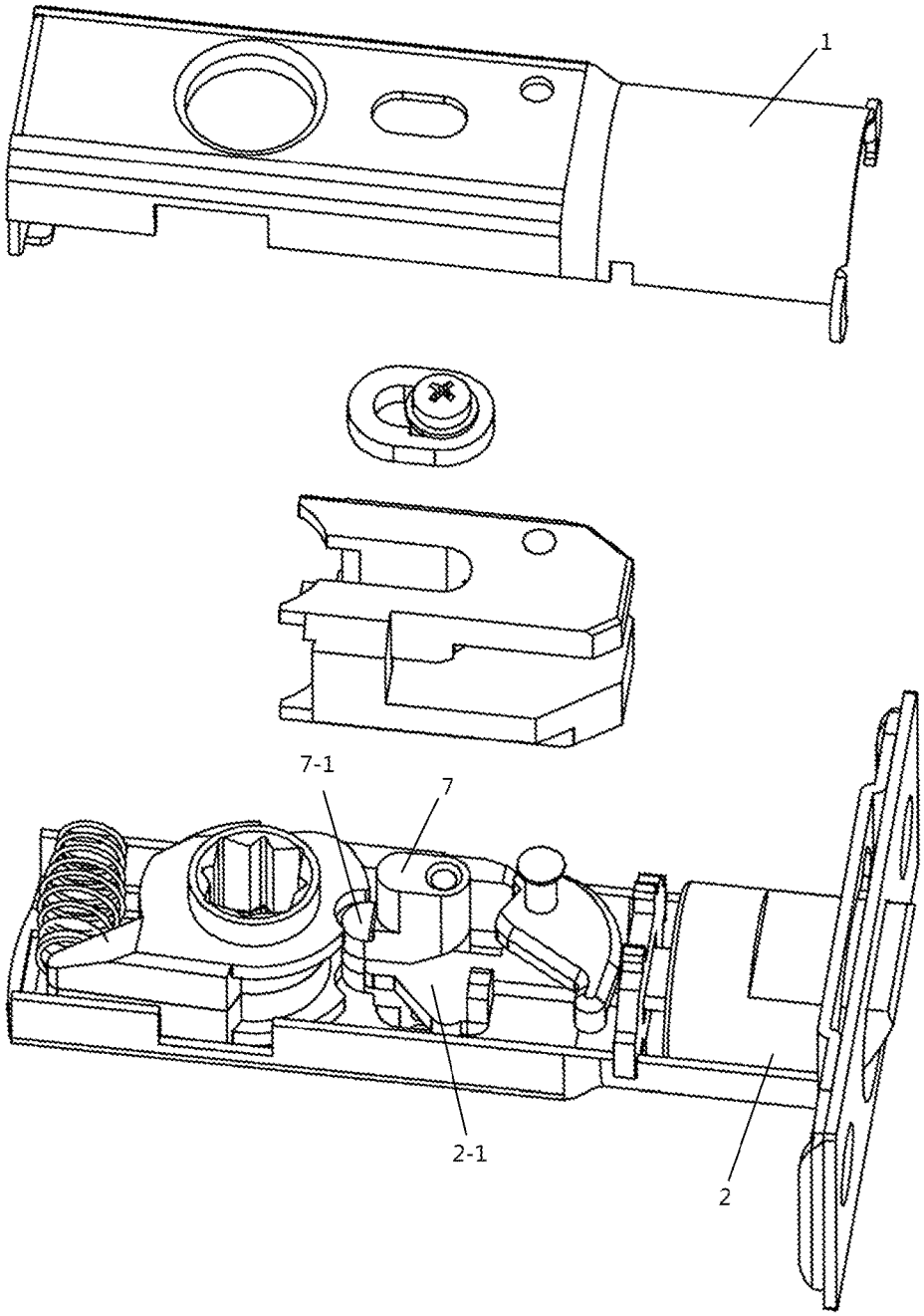
Figure 10:
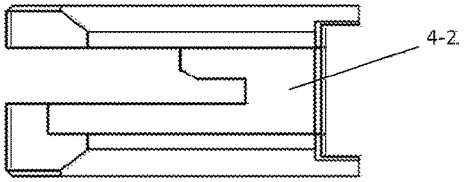
FIGS. 9-14 include a front view, bottom view, right view, left view, top view and perspective view of the support frame in the embodiment of FIG. 1.
Figure 11:
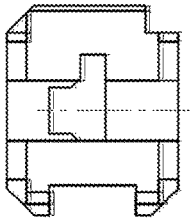
Figure 9:
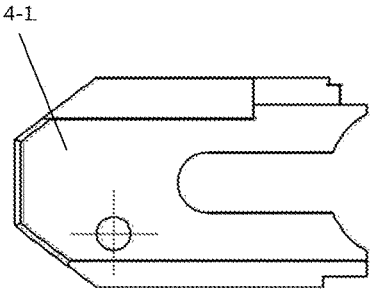
Figure 12:
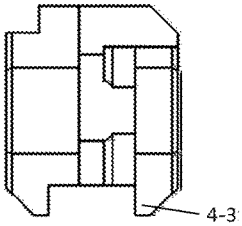
Figure 13:
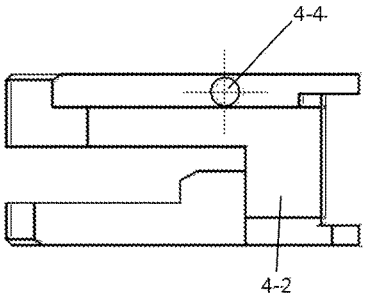
Figure 14:
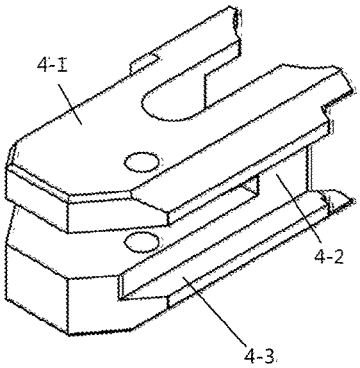
Figure 16:
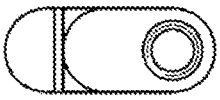
FIGS. 15-20 include a front view, bottom view, right view, left view, top view and perspective view of the braking element in the embodiment of FIG. 1.
Figure 20:
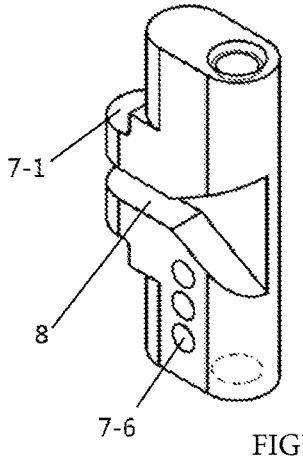
Figure 17:
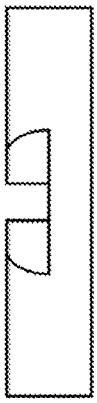
Figure 15:
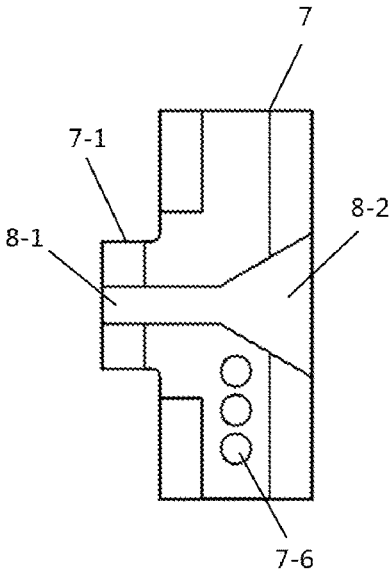
Figure 18:
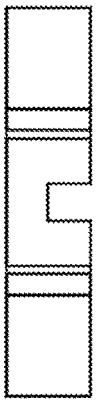
Figure 19:
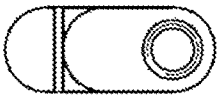
Figure 21:
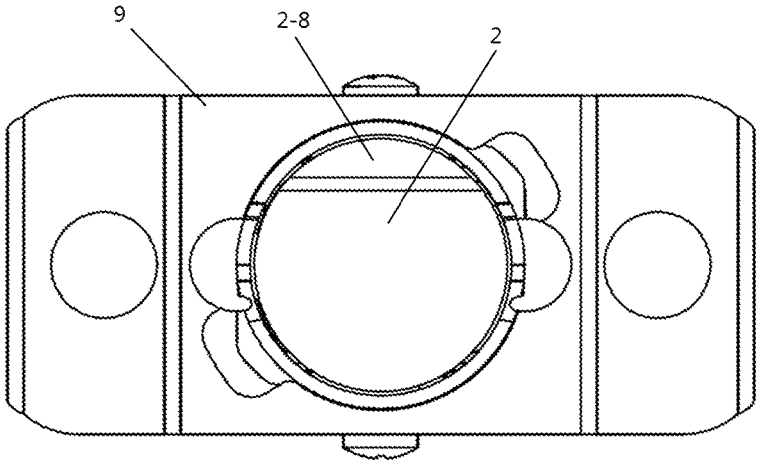
FIG. 21 is a front view of the matching of the lining board and the lock tongue in the embodiment of FIG. 1.

One side of the braking element 7 is provided with a set of ball type spacing holes 7-6 arranged along a line (vertically in FIGS. 7, 15 and 20). The support frame 4 has a fourth through hole 4-4, which contains the third elastomer 4-5 and ball 4-6, one end of the third elastomer 4-5 contacts the side of the shell 1, while the other end presses the ball 4-5 into a ball type spacing hole 7-6.

The door lock also comprises a lining board 9 and panel 10 permanently connected with the external door leaf via fasteners. The lining board 9 is located between the panel 10 and the open end of the shell 1. The lining board 9 has a circular hole 9-1 for the passage of lock tongue 2 and the panel 10 has a spacing hole 10-1 for the passage and locking of lock tongue 2. The edge of the spacing hole 10-1 is composed of a curved segment and a straight segment. The lock tongue 2 has a limit dais 2-8 protruding to the spacing hole 10-1. The four corners of the lining board 9 are round.

Embodiment 2

Figure 22:
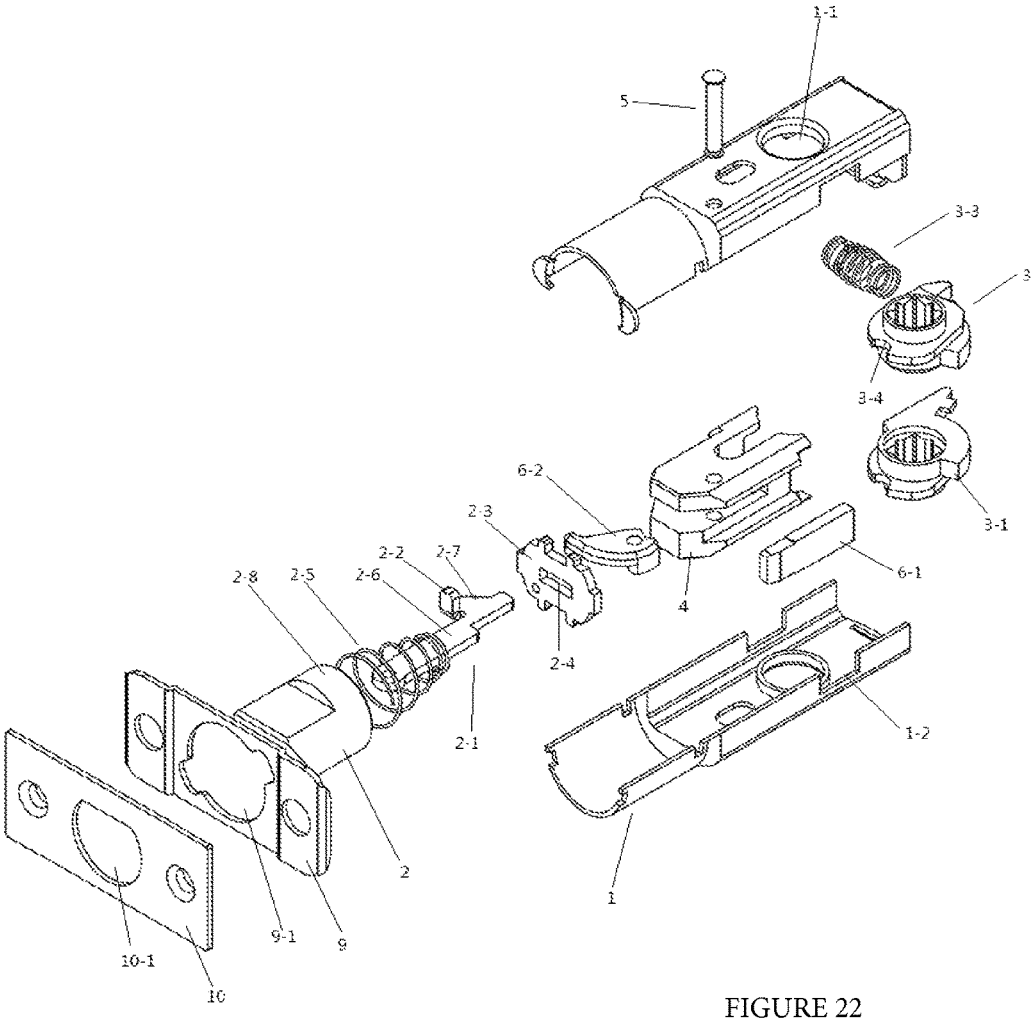
FIG. 22 is an exploded view of embodiment 2 of this invention, without the braking element.

The easily-assembled modular door lock in this embodiment is applicable to access doors. As shown in FIG. 22, the difference between its basic structure and that of embodiment 1 only lies in that, the door lock in this embodiment does not comprise: braking element 7, the first and second stop bolts 7-3, 7-4, gasket 7-5, ring part 7-2, the third elastomer 4-5 and ball 4-6.

Besides the embodiments described above, there may be other embodiments for this invention. Any technical schemes formed via identical replacement or equivalent transformation should fall within the protection scope claimed in this invention. This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. An easily-assembled modular door lock, comprising:

a tubular shell;

said shell having an open end and a longitudinally opposed closed end;

a lock tongue located at the open end of said shell;

said shell having two sides each equipped with a first through hole which facilitates the passage of a handle square bar;

wherein a turning wheel is located within the shell, said turning wheel having a second through hole to match the handle square bar;

said turning wheel having a perimeter edge spaced from said second through hole, said perimeter edge of said turning wheel having a flange thereon which faces the shell open end;

wherein a support frame is positioned between the turning wheel and the lock tongue and within said shell, said support frame including a drive located at least partially within said support frame;

wherein an end of said lock tongue closest to the closed end of the shell is permanently connected to a connection strap extending therefrom, said connection strap, drive-jointed with the flange of the turning wheel via the drive;

wherein said support frame comprises two support plates arranged parallel and opposite to each other, the parts of the two support plates near the closed end of the shell being fixed together via a supporting column;

said two support plates forming a space therebetween for containing and supporting said drive; and wherein a lateral side of each of said two support plates have a support chip therein, with a track formed between the two chips for supporting said drive as said drive translates along said track.

2. The door lock of claim 1 wherein said door lock has a first state of rotating the turning wheel by virtue of external force and making the flange of the turning wheel drive the lock tongue to draw back into the shell open end through action of the drive and the connection strap, as well as a second state that: after the external force is removed, the lock tongue will automatically reach outwards, the turning wheel will automatically rotate to an initial position, and the connection strap and drive will automatically return to their initial positions under the movement of the lock tongue.

3. The door lock of claim 1 wherein the said door lock also comprises a guide pile;

said drive comprising an elongated thrust plate which extends along a movement direction of the lock tongue and a cam-shaped pick;

said thrust plate lying in said track and forming a sliding pair; and said pick contained between the two support plates and close to the open end of the shell.

4. The door lock of claim 3 wherein said pick has a rotary point, both ends of the said pick lying on the two sides of the rotary point and respectively face the closed end of the shell;

one end of said thrust plate contacting the turning wheel flange end and the other end contacting one end of the pick, while the other end of said pick contacts a protruding plate of the connection strap; and one end of said pick closer to the rotary point of the pick than its other end.

5. The door lock of claim 4 wherein said pick is perpendicular to the guide pile;

the rotary point of said pick being rotary-jointed with the guide pile, both ends of said guide pile passing through the support plates and permanently connected with the shell;

said pick having an arc-shaped edge with its arc facing the open end of the shell; and the protruding plate of the connection strap lying on the side of the pick near the closed end of the shell.

6. An easily-assembled modular door lock, comprising:

a tubular shell;

said shell having an open end and a longitudinally opposed closed end;

a lock tongue located at the open end of said shell;

said shell having two sides each equipped with a first through hole which facilitates the passage of a handle square bar;

wherein a turning wheel is located within the shell, said turning wheel having a second through hole to match the handle square bar;

said turning wheel having a perimeter edge spaced from said second through hole, said perimeter edge of said turning wheel having a flange thereon which faces the shell open end;

wherein a support frame is positioned between the turning wheel and the lock tongue and within said shell, said support frame including a drive located at least partially within said support frame;

wherein an end of said lock tongue closest to the closed end of the shell is permanently connected to a connection strap extending therefrom, said connection strap drive-jointed with the flange of the turning wheel via the drive;

wherein said support frame comprises two support plates arranged parallel and opposite to each other, the parts of the two support plates near the closed end of the shell being fixed together via a supporting column;

said two support plates forming a space therebetween for containing and supporting said drive;

wherein a lateral side of each of said two support plates have a support chip therein, with a track formed between the two chips for supporting said drive as said drive translates along said track;

wherein said shell is also equipped with a lock tongue baffle plate perpendicular to the movement direction of the lock tongue, said lock tongue baffle plate lying between the lock tongue and the support frame;

said lock tongue baffle plate having a third through hole in the middle for the passage of the connection strap and the protruding plate of the connection strap lying on a side of the lock tongue baffle plate away from the lock tongue;

a first elastomer positioned between the lock tongue baffle plate and the lock tongue;

a side of said turning wheel away from its flange extending out through a support handle towards the closed end of the shell; and a second elastomer positioned between said support handle and the side of the shell adjacent to the turning wheel flange.

7. The door lock of claim 6 wherein a notch is provided on a side of the shell adjacent to the turning wheel flange.

8. The door lock of claim 7 wherein when the door lock is in the first state, said first and second elastomers are respectively in a first compression state, and said turning wheel flange end contacts the edge of the notch close to the opening end of the shell;

when the door lock is in a second state, said first and second elastomers are respectively at a stretched state or at a second compression state, with said turning wheel flange end lying in the notch; and wherein a compression amount of said first and second elastomers in said first compression state is bigger than their compression amount in said second compression state.

9. The door lock of claim 8 wherein said connection strap includes a baseplate extending along a movement direction of the lock tongue, one end of said baseplate lying on a side of the lock tongue baffle plate away from the lock tongue and contained in the support frame, while the other end lies on the other side of the lock tongue baffle plate near the lock tongue and is fixed with the lock tongue;

said baseplate extending out an accessory plate close to its one end, said protruding plate lying at the end of the accessory plate and permanently connected with the accessory plate; said said protruding plate being perpendicular to the movement direction of the lock tongue.

10. The door lock of claim 9 wherein when the door lock transforms from the first state to the second state, said turning wheel has a rotary angle of 28°.

11. An easily-assembled modular door lock, comprising:

a tubular shell;

said shell having an open end and a longitudinally opposed closed end;

a lock tongue located at the open end of said shell;

said shell having two sides each equipped with a first through hole which facilitates the passage of a handle square bar;

wherein a turning wheel is located within the shell, said turning wheel having a second through hole to match the handle square bar;

said turning wheel having a perimeter edge spaced from said second through hole, said perimeter edge of said turning wheel having a flange thereon which faces the shell open end;

wherein a support frame is positioned between the turning wheel and the lock tongue and within said shell, said support frame including a drive located at least partially within said support frame;

wherein an end of said lock tongue closest to the closed end of the shell is permanently connected to a connection strap extending therefrom, said connection strap drive-jointed with the flange of the turning wheel via the drive;

wherein said support frame comprises two support plates arranged parallel and opposite to each other, the parts of the two support plates near the closed end of the shell being fixed together via a supporting column;

said two support plates forming a space therebetween for containing and supporting said drive;

wherein a lateral side of each of said two support plates have a support chip therein, with a track formed between the two chips for supporting said drive as said drive translates along said track;

wherein said door lock also comprises a column-shaped braking element which is parallel to a central axis of the first through hole, said braking element extending out a limit boss towards the turning wheel, said turning wheel provided with a groove to match the limit boss; and said braking element running through the support frame, with both ends of said braking element exposed out of the shell and respectively equipped with a ring part circumferentially, both ends of said braking element respectively permanently connected with first and second stop bolts, a gasket positioned between caps of the first and second stop bolts and the corresponding ring parts.

12. The door lock of claim 11 wherein when the door lock is in a second state, said braking element has a braking state where the limit boss enters the groove and obstructs the turning wheel from rotating, the first stop bolt being jointed with the corresponding ring part, and the second stop bolt breaks away from corresponding ring part; and said door lock also including a non-braking state where the limit boss breaks away from the groove so that the turning wheel can rotate, with the first stop bolt breaking away from corresponding ring part and the second stop bolt is jointed with the corresponding ring part.

13. The door lock of claim 12 wherein when the door lock is in the first state, said braking element only has said non-braking state.

14. The door lock of claim 13 wherein said braking element is equipped with a chute extending along a movement direction of the lock tongue, a section of said chute along the movement direction of the lock tongue formed by a smooth connection of a rectangular chute segment away from the lock tongue and an isosceles trapezoidal chute segment close to the lock tongue, said rectangular chute segment and the isosceles trapezoidal chute segment being symmetric on a common axis of symmetry;

a side of said isosceles trapezoidal chute segment near the lock tongue being wider than a side away from the lock tongue; and when the door lock is in the first state, the end of the connection strap away from the lock tongue lies in the rectangular chute segment and when the door lock is in the second state, the end of the connection strap away from the lock tongue lies in the isosceles trapezoidal chute segment.

15. The door lock of claim 13 wherein one side of the braking element is provided with a set of ball type spacing holes arranged along a line, said support frame having a fourth through hole, which contains a third elastomer and ball, one end of said third elastomer contacting a side of the shell, while the other end presses the ball into a ball type spacing hole.

16. An easily-assembled modular door lock, comprising:

a tubular shell;

said shell having an open end and a longitudinally opposed closed end;

a lock tongue located at the open end of said shell;

said shell having two sides each equipped with a first through hole which facilitates the passage of a handle square bar;

wherein a turning wheel is located within the shell, said turning wheel having a second through hole to match the handle square bar;

said turning wheel having a perimeter edge spaced from said second through hole, said perimeter edge of said turning wheel having a flange thereon which faces the shell open end;

wherein a support frame is positioned between the turning wheel and the lock tongue and within said shell, said support frame including a drive located at least partially within said support frame;

wherein an end of said lock tongue closest to the closed end of the shell is permanently connected to a connection strap extending therefrom, said connection strap drive-jointed with the flange of the turning wheel via the drive;

wherein said support frame comprises two support plates arranged parallel and opposite to each other, the parts of the two support plates near the closed end of the shell being fixed together via a supporting column;

said two support plates forming a space therebetween for containing and supporting said drive;

wherein a lateral side of each of said two support plates have a support chip therein, with a track formed between the two chips for supporting said drive as said drive translates along said track;

wherein said door lock also comprises a lining board and a panel permanently connected with an external door leaf via fasteners, said lining board located between the panel and the open end of the shell;

said lining board having a partially circular hole for the passage of the lock tongue and said panel having a spacing hole for the passage and locking of the lock tongue; and the edge of said spacing hole composed of a curved segment and a straight segment.

17. The door lock of claim 16 wherein said lock tongue has a limit dais protruding to the spacing hole.

18. The door lock of claim 17 wherein four corners of said lining board are rounded.

* * * * *